US006652424B2

(12) United States Patent
Dalebout

(10) Patent No.: US 6,652,424 B2
(45) Date of Patent: Nov. 25, 2003

(54) TREADMILL WITH ADJUSTABLE CUSHIONING MEMBERS

(76) Inventor: William T. Dalebout, 1770 E. 1730 North, Logan, UT (US) 84321

( * ) Notice: Subject to any disclaimer, the term of this patent is extended or adjusted under 35 U.S.C. 154(b) by 83 days.

(21) Appl. No.: 09/777,141

(22) Filed: Feb. 5, 2001

(65) Prior Publication Data

US 2001/0016543 A1 Aug. 23, 2001

Related U.S. Application Data

(60) Continuation of application No. 09/437,387, filed on Nov. 10, 1999, now Pat. No. 6,280,362, which is a division of application No. 09/160,947, filed on Sep. 25, 1998, now Pat. No. 6,174,267.

(51) Int. Cl.[7] ..... A63B 22/00

(52) U.S. Cl. ..... 482/54; 482/51

(58) Field of Search ..... 482/51, 54

(56) References Cited

U.S. PATENT DOCUMENTS

| | | | |
|---|---|---|---|
| 3,592,466 | A | 7/1971 | Parsons |
| 3,689,066 | A | 9/1972 | Hagen |
| 4,350,336 | A | 9/1982 | Hanford |
| 4,509,510 | A | 4/1985 | Hook |
| 4,548,405 | A | 10/1985 | Lee et al. |
| 4,576,376 | A | 3/1986 | Miller |
| 4,616,822 | A | 10/1986 | Trulaske et al. |
| 4,819,583 | A | 4/1989 | Guerra |
| 4,886,266 | A | 12/1989 | Trulaske |

(List continued on next page.)

OTHER PUBLICATIONS

Precor USA M9.3 Low Impact Treadmill Brochure, Copyright 1990.

U.S. patent application Publication, Publication No. US 2002/0010055A1, Publication Date Jan. 24, 2002, Inventors: Dyer et al.

Kutz, M., ed., Mechanical Engineer's Handbook, 2$^{nd}$ ed., New York: John Wiley & Son Inc., 1998.

Hibbler, R.C., Engineering Mechanics Statics, 4$^{th}$ ed., New York: Macmillan Publishin Company, 1986.

*Primary Examiner*—Glenn E. Richmon

(74) *Attorney, Agent, or Firm*—Workman, Nydegger & Seeley

(57) ABSTRACT

A treadmill with an adjustable cushioning mechanism configured to adjustably cushion the impact to a user who is exercising on the treadmill. The adjustable cushioning members allow the user to select the amount of cushioning that will be provided while the user is exercising on the treadmill by adjusting the cushioning members to individualize the amount of cushioning for a specific user as well as for a particular type of exercises. The treadmill comprises a frame and an endless belt trained on the frame. The belt has an upwardly exposed exercise section. A deck is disposed between the exercise section of the belt and the frame. The treadmill also comprises a plurality of cushioning members each having a plurality of portions with different cushioning properties. The cushioning members are positioned on opposing sides of the frame. The cushioning members are mechanically interconnected such that movement of one of the cushioning members results in corresponding movement of the other of the cushioning members. The cushioning members are configured to be adjusted so as to selectively position a portion of the cushioning members between the frame and the deck. An adjustable flexible cantilever is disclosed that comprises an arm and a bumper. The arm has one end mounted to the frame and the other end freely disposed from the frame. The bumper extends between the free end of the arm and the deck. A brace mounted to the frame adjacent to the cantilever that can be selectively moved along the length of the cantilever.

22 Claims, 8 Drawing Sheets

U.S. PATENT DOCUMENTS

| | | | | |
|---|---|---|---|---|
| 4,938,473 | A | | 7/1990 | Lee et al. |
| 4,984,810 | A | | 1/1991 | Stearns et al. |
| 5,072,928 | A | | 12/1991 | Stearns et al. |
| 5,088,729 | A | | 2/1992 | Dalebout |
| 5,184,988 | A | | 2/1993 | Dunham | 482/54 |
| 5,250,012 | A | | 10/1993 | Meredith | 482/54 |
| 5,279,528 | A | | 1/1994 | Dalebout et al. | 482/54 |
| 5,330,401 | A | | 7/1994 | Walstead | 482/54 |
| 5,336,144 | A | | 8/1994 | Rodden | 482/54 |
| 5,344,372 | A | | 9/1994 | Hung | 482/54 |
| 5,374,227 | A | | 12/1994 | Webb |
| 5,382,207 | A | | 1/1995 | Skowronski et al. | 482/54 |
| 5,441,468 | A | | 8/1995 | Deckers et al. | 482/54 |
| 5,454,772 | A | | 10/1995 | Rodden | 482/54 |
| 5,476,430 | A | | 12/1995 | Lee et al. | 482/54 |
| 5,484,362 | A | | 1/1996 | Skowronski et al. | 482/54 |
| 5,518,471 | A | | 5/1996 | Hettinger et al. |
| 5,527,245 | A | | 6/1996 | Dalebout et al. |
| 5,542,892 | A | | 8/1996 | Buhler | 482/54 |
| 5,599,259 | A | | 2/1997 | Skowronski et al. | 482/54 |
| 5,626,539 | A | | 5/1997 | Piaget et al. | 482/54 |
| 5,634,870 | A | | 6/1997 | Wilkinson |
| 5,649,882 | A | | 7/1997 | Parikh et al. | 482/54 |
| 5,690,587 | A | | 11/1997 | Gruenangerl |
| 5,749,807 | A | | 5/1998 | Webb |
| 5,752,897 | A | | 5/1998 | Skowronski et al. |
| 5,810,696 | A | | 9/1998 | Webb |
| 5,827,155 | A | | 10/1998 | Jensen et al. | 482/54 |
| 5,976,061 | A | | 11/1999 | Moon et al. | 482/54 |
| 5,980,432 | A | | 11/1999 | Ahman |
| 5,993,358 | A | | 11/1999 | Gureghiam et al. | 482/54 |
| 6,013,011 | A | * | 1/2000 | Moore et al. | 482/54 |
| 6,045,490 | A | * | 4/2000 | Shafer et al. | 482/54 |
| 6,050,921 | A | | 4/2000 | Wang |
| 6,053,848 | A | | 4/2000 | Eschenbach |
| 6,068,578 | A | | 5/2000 | Wang |
| 6,095,951 | A | | 8/2000 | Skowronski et al. |
| 6,132,340 | A | | 10/2000 | Wang et al. |
| 6,174,267 | B1 | | 1/2001 | Dalebout et al. | 482/54 |
| 6,174,268 | B1 | | 1/2001 | Novak |
| 6,179,753 | B1 | | 1/2001 | Barker et al. |
| 6,234,936 | B1 | | 5/2001 | Wang |
| 6,280,362 | B1 | | 8/2001 | Dalebout et al. |
| 6,328,676 | B1 | | 12/2001 | Alessandri |
| 6,394,239 | B1 | | 5/2002 | Carlson |
| 6,436,008 | B1 | | 8/2002 | Skowronski et al. |

* cited by examiner

TREADMILL WITH ADJUSTABLE CUSHIONING MEMBERS

RELATED APPLICATIONS

This patent application is a continuation of a U.S. patent application entitled "Treadmill with Adjustable Cushioning Members" to Dalebout, et al, filed on Nov. 10, 1999, Ser. No. 09/437,387, now U.S. Pat. No. 6,280,362 which is incorporated herein by reference, and which is a divisional application of a U.S. patent application entitled "Treadmill with Adjustable Cushioning Members" to Dalebout, et al, filed on Sep. 25, 1998, Ser. No. 09/160,947, now U.S. Pat. No. 6,174,267, which is incorporated herein by reference.

BACKGROUND OF THE INVENTION

1. The Field of the Invention

The present invention relates to treadmills, and more particularly to treadmills with adjustable cushioning members to manually, adjustably cushion the impact when a user is operating the treadmill.

2. Present State of the Art

Treadmills have become increasingly popular in recent years as a piece of exercise equipment. Treadmills can be used for either running or walking indoors such as at home or in the office. Most exercise treadmills include an exercise platform that includes an elongated frame with a first and second roller assembly mounted across opposite lateral ends of the frame. An endless belt is mounted for travel about the roller assemblies. The belt is flexible and unable to rigidly support the weight of the user. The belt is usually supported by a deck that is disposed between the upper portion of the belt and the frame. The deck is usually made of rigid material. The belt is controlled by a motor. As the user walks or runs on the belt, the belt is pressed against the underlying deck to provide mechanical support for a user.

In some types of treadmills, the decks were directly affixed to the frame to provide rigid support. As a result, the shock from the user's step is reflected by the deck back to the foot, ankle and leg of the user in a similar manner as the reactive forces are imposed on a walker, a jogger or a runner exercising on a hard-paved surface or a sidewalk. Over long periods of time, the shock experienced by the user can have detrimental effects to the joint of the user. Even in the short term, exercising on a rigid surface may prove to be tiring and jarring to a user. Attempts have been made to provide a way to cushion the impact felt by the user on the treadmill while still providing a rigid support surface for the belt and exerciser.

One method of attempting to cushion the impact felt by the user is to provide an intricate shock absorbing system which was attached to both the frame and the deck. The intricate shock absorbing system, however, is difficult to manufacture and cost prohibitive. Another attempt to provide cushioning to the user has been attaching rubber blocks or cushioning strips mounted along the length of the frame prior to mounting the deck to the frame. One problem with the rubber blocks or cushioning strips mounted between the deck and frame is that the blocks did not deform equally between users having different weights. As a result, for some users there was insufficient cushioning and with another user the treadmill was too soft. Another method of providing cushioning on treadmills is the use of several elastomeric springs that are positioned between the frame and the deck. The elastomeric springs were intended to provide an amount of resistance that is proportional to the extent that the deck deflected in response to a user exercising.

As recognized with the use of rubber blocks, users that have differing weights do not obtain the same amount of deflection of the deck and therefore need differing amounts of cushioning. In addition, the amount of cushioning that is desired may depend upon the exercise that is being performed on the treadmill. For instance, a user who is running on the treadmill will most likely need more cushioning than a user who is walking on the treadmill. In addition, there is often just a difference of personal taste in the amount of cushioning that is desired. Some users may prefer to exercise on a firmer surface while others would prefer to exercise on a surface with a great deal of cushion. One attempt to provide a treadmill that could provide individualized cushioning required physically removing strips of cushioning material and inserting other strips into the treadmill. This was time consuming and awkward.

What is needed is a treadmill in which a user may manually adjust the amount of cushioning that will be provided without having to disassemble and remove pieces of the treadmill.

OBJECTS AND BRIEF SUMMARY OF THE INVENTION

It is, therefore, an object of the present invention to provide a treadmill with a cushioning mechanism that can be conveniently manually adjusted to provide differing amounts of cushioning to a user exercising on the treadmill.

It is another object of the present invention to provide a treadmill that can be conveniently adjusted to provide differing amounts of cushioning without disassembling the cushioning mechanism.

It is yet another object of the present invention to provide a treadmill with a cushioning mechanism that can be conveniently adjusted to provide differing amounts of cushioning depending on the different type of exercises to be performed on the treadmill.

A further object of the present invention is to provide a treadmill with a cushioning mechanism that can be selectively adjusted to provide differing amounts of cushioning based on individual preferences.

Additional objects and advantages of the invention will be set forth in the description which follows, and in part will be obvious from the description, or maybe learned by the practice of the invention. The objects and advantages of the invention maybe realized and obtained by means of the instruments and combinations particularly pointed out in the appended claims.

To achieve the foregoing objects, and in accordance with the invention as embodied and broadly described herein a treadmill with an adjustable impact absorbing mechanism is provided. The impact absorbing mechanism is configured to adjustably cushion the impact to a user who is exercising on the treadmill. The adjustable impact absorbing mechanism allows the user to select the amount of cushioning that will be provided while the user is exercising on the treadmill by manually adjusting the impact absorbing mechanism to individualize the amount of cushioning for a specific user as well as for a particular type of exercises.

The treadmill comprises a frame and an endless belt trained on the frame. The belt has an upwardly exposed exercise section. A deck is disposed between the exercise section of the belt and the frame. The treadmill also comprises a plurality of cushioning members each having a plurality of portions with different cushioning properties. The cushioning members are positioned on opposing sides of the frame. The cushioning members are configured to be adjusted so as to selectively position a portion of the cushioning members between the frame and the deck. The cushioning members are mechanically interconnected such that movement of one of the cushioning members results in corresponding movement of the other of the cushioning members.

An embodiment with an adjustable flexible cantilever is also provided. The cantilever comprises a flexible arm and a bumper. The arm has one end mounted to the frame and the other end freely disposed from the frame. The bumper extends between the free end of the arm and the deck. The cantilever also included a brace mounted to the frame adjacent to the cantilever. The brace can be selectively moved along the length of the cantilever.

These and other objects and features of the present invention will become more fully apparent from the following description and appended claims, or may be learned by the practice of the invention as set forth hereinafter.

BRIEF DESCRIPTION OF THE DRAWINGS

In order that the manner in which the above-recited and other advantages and objects of the invention are obtained, a more particular description of the invention briefly described above will be rendered by reference to specific embodiments thereof which are illustrated in the appended drawings. Understanding that these drawings depict only typical embodiments of the invention and are not therefore to be considered to be limiting of its scope, the invention will be described and explained with additional specificity and detail through the use of the accompanying drawings in which.

DETAILED DESCRIPTION OF THE PREFERRED EMBODIMENTS

Figure 1:
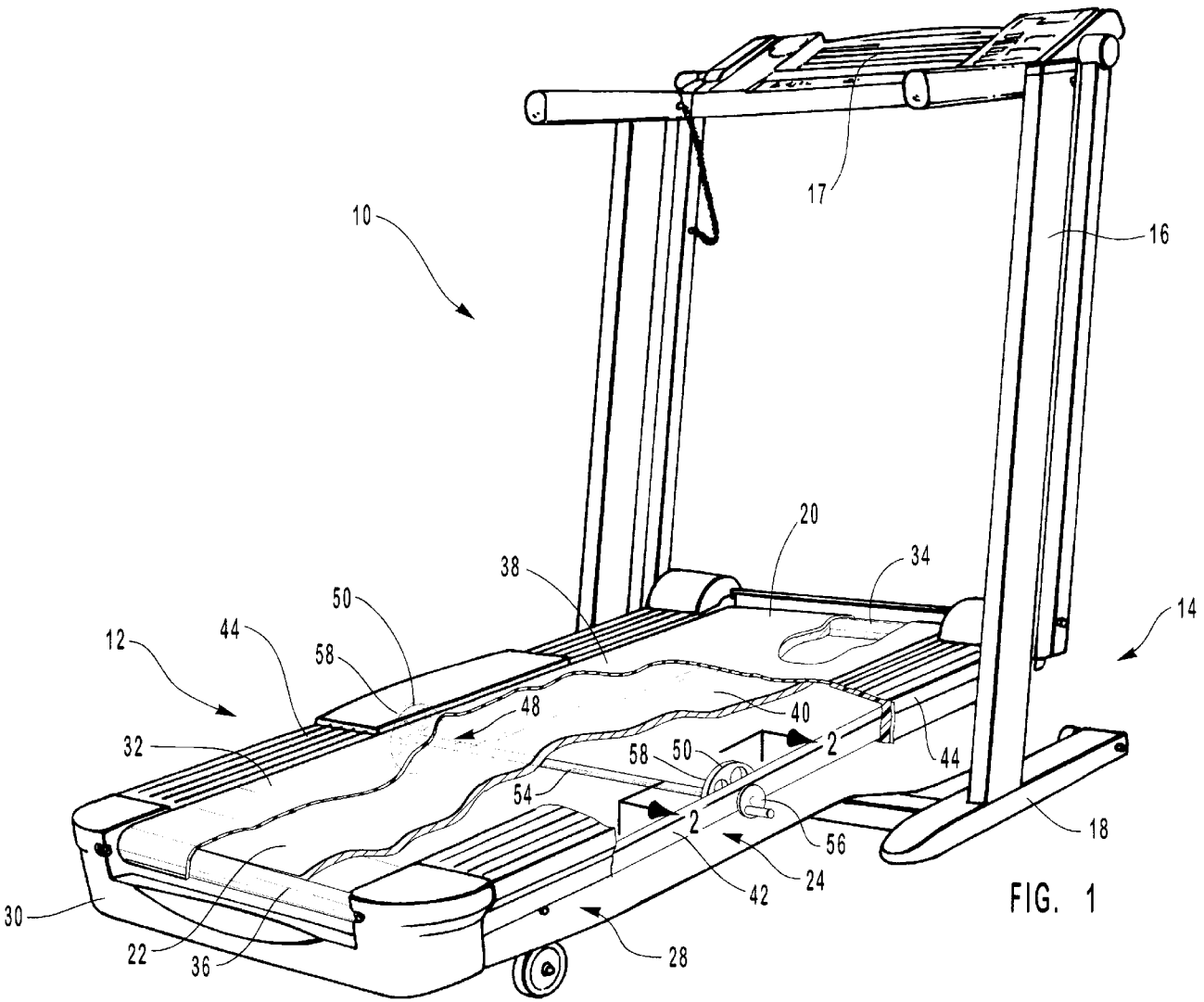
FIG. 1 is partial cutaway perspective view of a treadmill with one embodiment of a cushioning mechanism.

The present invention relates to treadmills with an impact absorbing mechanism that is configured to adjustably cushion the impact to a user who is exercising on the treadmill. Depicted in FIG. 1 is one embodiment of a treadmill incorporating the features of the present invention. The adjustable impact absorbing mechanism in the present invention allows a user to select the amount of cushioning that will be provided while the user is exercising on the treadmill by manually adjusting the impact absorbing mechanism to individualize the amount of cushioning for a specific user as well as for a particular type of exercises. The manual adjustments made by a user to the impact absorbing mechanism are done without any disassembly of the treadmill.

As illustrated in FIG. 1, one embodiment of a treadmill 10 includes an exercise base 12 and a support structure 14. Support structure 14 comprises a handrail 16 that extends upwardly from exercise base 12 and a feet means for supporting treadmill 10 upon a support surface such as a floor. One embodiment of structure capable of performing the function of such a feet means are feet 18. It is to be understood that although FIG. 1 illustrates foot 18 only on the right side of handrail 16 there is another foot 18 on the left side of handrail 16. Left and right are defined when a user is facing support structure 14 while standing on exercise base 12.

Handrail 16 may comprise an optional control console 17. Console 17 is attached to the upper end of handrail 16 and extends laterally over exercise base 12. Console 17 may have an operating control such as an actuator switch to operate treadmill 10 and an indicator means which may be operated by the user to determine various parameters associated with the exercise being performed. Console 17 may also include such things as a cup or glass holder so that the user may position a liquid refreshment for use during the course of performing the exercise. It can be appreciated that various embodiments of console 17 are possible and may be so simple as to include only an on/off switch. It is contemplated that console 17 may be completely replaced by a lateral support member.

Exercise base 12 has a front end 20 and a back end 22. As illustrated in FIG. 1, front end 20 of exercise base 12 is attached to support structure 14. In this embodiment, front end 20 of treadmill 10 is rotatably attached to support structure 14 such that exercise base 12 can be rotated between an operational position, as is illustrated in FIG. 1, and a storage position in which exercise base 12 is substantially vertical. It can be appreciated that various other methods of attaching exercise base 12 to support structure 14 are equally effective in carrying out the intended function thereof. In addition, there is no requirement that exercise base 12 be rotatable. It is contemplated that exercise base 12 can be fixedly attached to support structure 14.

Referring to FIG. 1, exercise base 12 comprises a frame 24 that includes a right frame member 28 and a left frame member (not shown). In FIG. 1, however, as previously mentioned only the right side of treadmill 10 is visible. It is intended that the left side of frame 24 of treadmill 10 be a mirror image of the structure discussed relative to the right side. Right frame member 28 and left frame member (not shown) are in a spaced-apart, longitudinal relationship and are substantially parallel. Exercise base 12 also comprises a rear support member 30 that is attached to right frame member 28 and left frame member (not shown) at back end 22 of exercise base 12.

Exercise base 12 comprises a front roller 34 and a back roller 36 that are attached laterally near front end 20 and back end 22 of frame 24, respectively. An endless belt 32 is trained over front roller 34 and back roller 36 and is positioned between right frame member 28 and left frame member (not shown) so that belt 32 has an upwardly exposed exercise section 38 upon which a user exercises.

Figure 2:
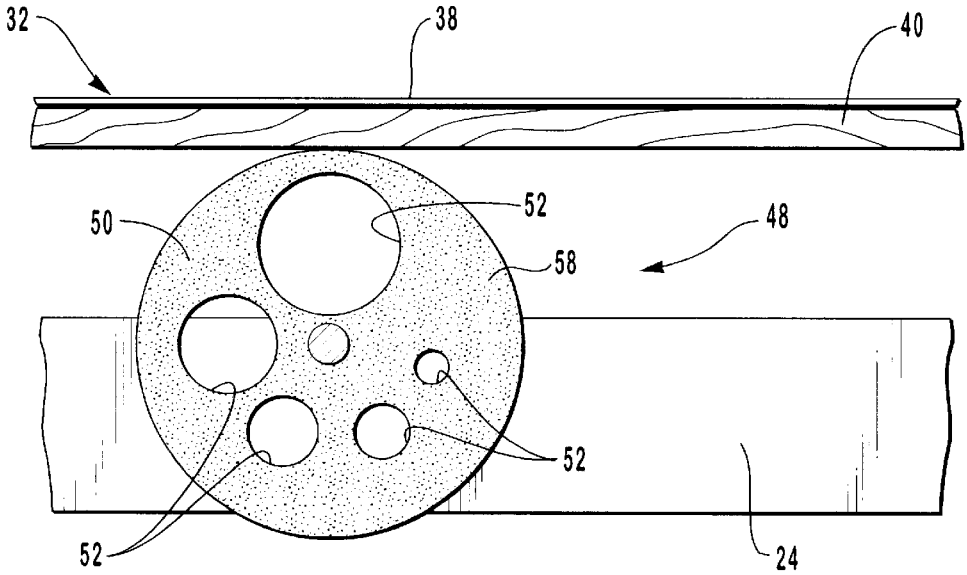
FIG. 2 is a partial cross-sectional elevation view of the cushioning mechanism shown in FIG. 1 taken along section line 2—2 therein.

As depicted in FIGS. 1 and 2, exercise base 12 includes a deck 40 that is disposed between exercise section 38 of belt 32 and frame 24. Deck 40 is substantially rigid and provides rigid support to a user exercising on exercise section 38 of belt 32. Belt 32 and deck 40 are configured to receive a user thereon to perform exercises including walking, running, jogging and other similar related activities. Treadmill 10 can also be used for stationary exercises such as stretching or bending while the user is standing on belt 32.

In one embodiment, at least one of the front 20 and back end 22 of deck 40 is not secured to the frame, but instead, moves freely from frame 24. This permits greater adjustment of cushioning applied to that end of the deck 40. For example, in one embodiment, the front end 20 of deck 40 is not secured to frame 24, but instead, the back end 22 of deck 40 is secured to frame 24 (through the use of screws, for example), while the front end 20 deflects freely from frame 24. This permits greater adjustment of cushioning applied to the front end 22 of deck 40.

However, in another embodiment, both front end 20 and back end 22 of deck 40 are secured to frame 24 through the use of screws, for example, and adjustable cushioning is applied to the central portion of deck 40 between opposing ends 20 and 22. Optionally, adjustable cushioning can be applied in front and/or in back of the points of securement of deck 40 to frame 24.

One embodiment of right frame member 28 and left frame member (not shown) comprises a side rail 42 and a side platform 44. As illustrated in FIG. 1, side platform 44 is positioned over the top of side rail 42 of both right frame member 28 and left frame member (not shown). Side platforms 44 are positioned on each side of belt 32 and are capable of supporting the weight of a user standing thereon.

The position of side platforms 44 are such that a user of treadmill 10 can comfortably and easily step off of belt 32 onto one or both of side platforms 44. A user can also stand on side platform 44 on either side of exercise base 12 until he or she is ready to step onto belt 32. It can be appreciated that other embodiments of frame 24 that include right frame member 28 and left frame member (not shown) or the components thereof are equally effective in carrying out the intended function thereof.

The present invention includes an impact absorbing mechanism 48 that is configured for manual adjustment to provide selectable amounts of impact cushioning when a user is operating on exercise section 38 of belt 32. Impact absorbing mechanism allows the amount of cushioning provided by treadmill 10 to be manually adjusted to individualize treadmill 10 for different uses and/or users.

One embodiment of impact absorbing mechanism 48 is depicted in FIGS. 1 and 2. As illustrated in FIG. 1, impact absorbing mechanism 48 comprises a plurality of cushioning members 50 that are positioned between deck 40 and frame 24. Although FIG. 1 illustrates two (2) cushioning members 50, it can be appreciated that various other numbers of cushioning members 50 can be used. This is true with all of the embodiments illustrated in FIGS. 1–8. Cushioning members 50 are attached to opposing sides of frame 24 and are at least partially disposed between frame 24 and deck 40. Cushioning members 50 are substantially opposite each other on frame 24 and are substantially perpendicular to deck 40. Cushioning members 50 comprise a plurality of portions having different cushioning properties. As depicted in FIG. 1, cushioning members 50 are attached to the inside surface of frame 24. It is contemplated, however, that cushioning members 50 can be attached to the outside surface of frame 24 and perform the function thereof equally effectively.

Cushioning members 50 comprise flexible bases 58. Bases 58 have an opening or cut-out 52 formed in the different portions of cushioning member 50 as shown in FIG. 2. Each opening 52 is a different size. As the size of opening 52 increases, the stiffness of that portion of cushioning members 50 decreases. As a result, the size of opening 52 in cushioning members 50 is related to the flexibility that portion of cushioning members 50. The portions of cushioning member 50 will have different cushioning properties due to the varying size of openings allows a user of treadmill 10 who may desire less cushioning, for example, to manually adjustably position cushioning members 50 so that the portion of cushioning members 50 with the smallest openings 52 and, therefore, the least flexibility is proximate to deck 40. In this position, cushioning members 50 have an increased stiffness which results in less cushioning. In contrast, when more cushioning is desired, cushioning members 50 are rotated to adjust cushioning members 50 so that a portion of bases 58 with progressively increasing sized openings is against deck 40, thereby increasing the flexibility and cushioning of cushioning members 50.

As shown in FIGS. 1 and 2, bases 48 of cushioning members 50 are configured in a disk-like shape. The shape of bases 58 of cushioning members 50 is not particularly important. Various other configurations of bases 58 of cushioning members 50 are equally effective in carrying out the intended function thereof. Bases 58, as shown, are substantially planar. It is not, however, required that bases 58 of cushioning members 50 be planar. Bases 58 of cushioning members 50 may have various other configurations such as elliptical, oval, or octagonal. What is important is that bases 58 of cushioning members 50 have portions of differing amounts of stiffness to correspondingly provide differing cushioning in absorbing the impact between deck 40 and frame 24 when a user is operating on exercise section 38 of belt 32. Cushioning members 50 must be manually adjustable to provide selectable amounts of impact cushioning when a user is operating on exercise section 38 of belt 32.

As illustrated in FIG. 1, impact absorbing mechanism 48 also comprises means for manually adjusting cushioning members 50 so as to selectively position a select one of the plurality of portions of cushioning members 50 between frame 24 and deck 38. It is intended that the term "manually" mean that the user of treadmill 10 must physically do something to select among the various amounts of cushioning that can be provided by impact absorbing mechanism. Manually can mean physically moving or rotating cushioning members 50 or pressing a button on console 17 which causes cushioning members 50 to be automatically and selectively adjusted to provide the desired amount of cushioning. It is, therefore, intended that the term "manually" be interpreted broadly to just require a user to do some thing such as pressing a button or actually positioning cushioning members 50 to adjust the amount of cushioning.

One example of structure capable of performing the function of such a means for manually adjusting cushioning members 50 comprises a handle 56. As depicted in FIG. 1, one embodiment of handle 56 is mounted outside frame 24 and is attached to one of cushioning members 50. Handle 56 is configured to cooperate with frame 24. Other embodiments of handle 56 perform the function thereof equally effectively. For example, handle 56 may be a knob attached to base 58 of one of cushioning members 50, particularly if cushioning members 50 are attached to the outside surface of frame 24. Handle 56 may be elongated, oval, round, square, or various other geometric shapes. Handle 56 must just be something that the user can easily grasp. Other embodiments of handle 56 may include some type of an elongated lever or rod. If means for manually adjusting cushioning members 50 is mounted on console 17, it may comprise a button that is indexed to automatically incrementally adjust cushioning members 50 to the specific amounts of cushioning. Other embodiments of means for manually adjusting cushioning members 50 are some sort of a lever that is slidable on console 17 or knob attached to console 17 that can be selectively rotated. Either the knob, lever or some other embodiment can be moved on the console 17 by the user to position bases 58 of cushioning members 50 to corresponding positions to provide the selected amount of cushioning.

Impact absorbing mechanism 48 may optionally comprise means for mechanically interconnecting cushioning members 50 such that movement of one of cushioning members 50 results in corresponding movement of the other second cushioning members 50. One embodiment of structure capable of performing the function of such a means for mechanically interconnecting the plurality of cushioning members 50 comprises an elongated axle 54 that is depicted in FIG. 1. Axle 54 is attached to cushioning members 50 and extends laterally therebetween. As the user of treadmill 10 adjusts one of cushioning members 50 using handle 56 to select the desired amount of cushioning, axle 54 translates the movement to the remaining cushioning members 50. Consequently, all of cushioning members 50 move substantially simultaneously to the selected position to provide the desired amount of cushioning.

As illustrated, axle 54 is substantially round. Axle 54 could, however, have other embodiments such as square, oval, or rectangular. Various other configurations of means for mechanically interconnecting first and second cushioning members 50 are capable of performing the function thereof equally effectively. Alternatively, means for mechanically interconnecting cushioning members 50 may comprise a linkage or a cable as will be discussed in further detail below.

In those embodiments of impact absorbing mechanism 48 that do not comprise a means for mechanically interconnecting cushioning members 50, all of cushioning members 50 have means of adjusting cushioning member 50 so as to selectively position a select one of the plurality of portions 58 of cushioning member 50 between frame 24 and deck 40. For example, as depicted in FIG. 1, first and second cushioning members 50 may each have a handle, such as handle 56, attached thereto. This embodiment would require a user to first make the adjustment to first cushioning member 50 located on one side of treadmill 10 and then move to the opposite side to manually adjust to second cushioning member 50 or vice versa. The drawback with this embodiment is in that a user might forget to adjust cushioning members 50 on the opposite side or may inadvertently adjust only cushioning members 50 on one side of treadmill 10 resulting in cushioning members 50 having different settings.

A variety of different adjustable cushioning members may be provided along the length of the base 12 in order to provide a substantially horizontal deck 40. It is also possible to employ both adjustable and non-adjustable cushioning members between frame 24 and deck 40 in order to provide a substantially horizontal deck 40.

The remaining figures illustrate other embodiments of impact absorbing mechanisms and cushioning members. The majority of features previously discussed relative to FIGS. 1 and 2 apply to the remainder of the figures.

Figure 3:
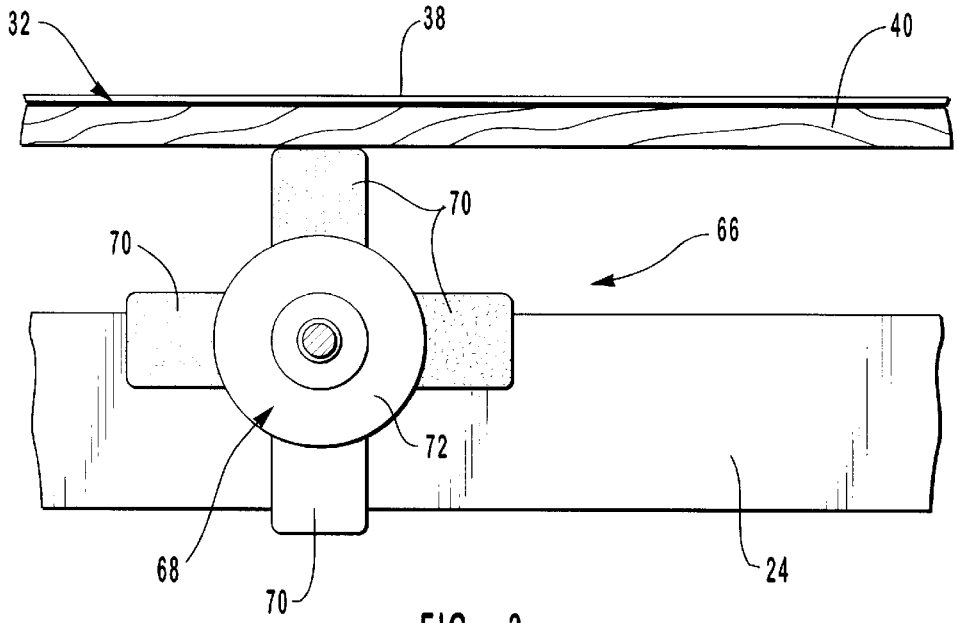
FIG. 3 is a partial cross-sectional elevation view of another embodiment of a cushioning mechanism.

FIG. 3 depicts another embodiment of impact absorbing mechanism 66. One of the plurality of cushioning members 68 is shown in FIG. 3. Impact absorbing mechanism 66 comprises a plurality of substantially identical cushioning members 68. Cushioning members 68 are movably attached to frame 24 and are substantially perpendicular to deck 40. As with cushioning members 50, cushioning members 68 each may be attached either inside or outside frame 24.

Cushioning members 68 comprise a plurality of portions having different cushioning properties. Cushioning members 68 each comprise a base 72 having a plurality of arms 70 projecting therefrom. In the embodiment depicted in FIG. 3, base 72 is substantially round. Various other configurations of base 72 are capable of performing the function thereof with equal effectiveness. Base 72 could, for example, alternatively be square, oval, elliptical, octagonal or even triangular. Arms 70 project radially from base 72. While FIG. 3 illustrates that cushioning members 68 have four (4) arms 70, it is contemplated that any number of arms 70 other than one (1) can be utilized. What is important is that the user can manually adjust cushioning members 68 to select between differing amounts of cushioning. Arms 70 and base 72 are substantially parallel.

Arms 70 of cushioning members 68 are made of various materials with each having differing stiffness characteristic such that each of arms 70 experiences a differing amount of deflection when contacting deck 40 in response to a force from the impact of a user on exercise section 38 of belt 32. In one embodiment of cushioning members 68, arms 70 are substantially comprised of materials selected from the group consisting of plastic, hard rubber, soft rubber, and cellular foam. Various other kinds of materials that have differing stiffness characteristics may alternatively be used. In addition, although depicted in FIG. 3 as being substantially rectangular, arms 70 may have other configurations such as being square, semispherical, half an ellipse, half an oval, or a truncated cone and perform the function thereof equally effectively.

Figure 4:
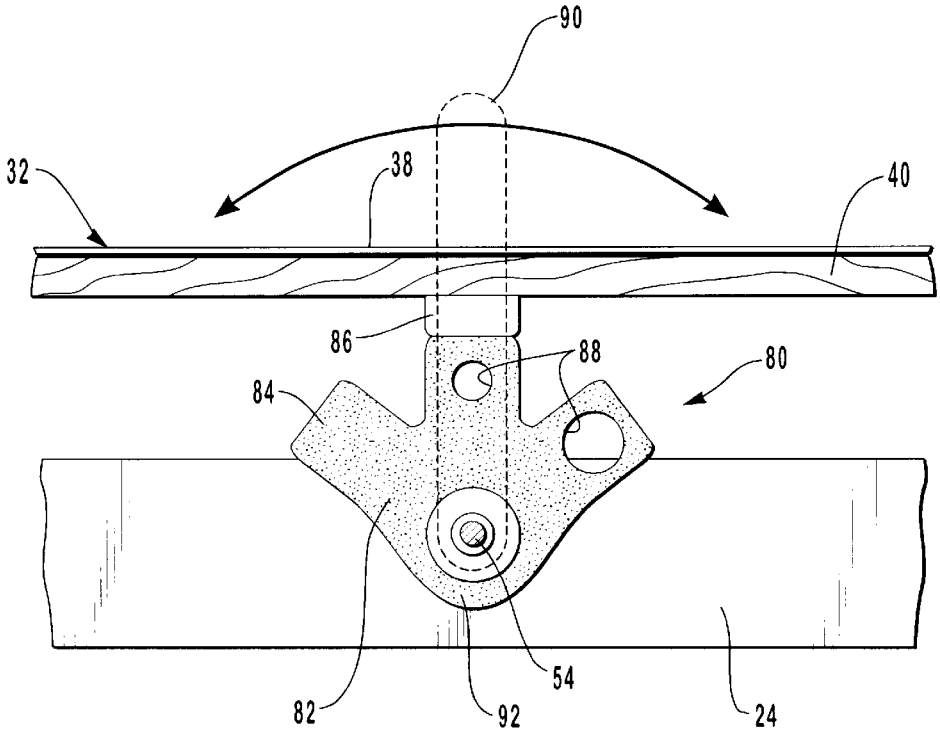
FIG. 4 is a partial cross-sectional elevation view of another embodiment of a cushioning mechanism.

FIG. 4 illustrates another embodiment of an impact absorbing mechanism 80 that comprises cushioning members 82. Like cushioning members 50 and 68 depicted in FIGS. 1–3, cushioning members 82 are movably attached to frame 24 and are disposed substantially perpendicular to deck 40. Cushioning member 82 comprise a plurality of portions having different cushioning properties. Cushioning members 82 comprise a base 92 with arms 84 extending therefrom. In this embodiment, cushioning members 82 are substantially fan-shaped. Like cushioning members 68 depicted in FIG. 3, cushioning members 82 have arms 84 extending outwardly from base 92. In this embodiment, as illustrated in FIG. 4, cushioning members 82 have three (3) arms 84. As previously mentioned, cushioning members 82 could, however, have various other numbers of arms 84.

Although cushioning members 68 and 92 illustrated in FIGS. 3 and 4 have arms 70 and 84, respectively, that are parallel to bases 72 and 92, respectively, arms 70 and 84 are not required to be parallel to bases 72 and 82. Instead, bases 72 or 92 could be mounted on frame 24 so as to be substantially parallel with deck 40. Arms 70 or 84 while extending outwardly from bases 72 or 92 now extend upward toward deck 40. For example, arms 70 and 84 could be "L-shaped." This embodiment of cushioning members performs the function thereof equally effectively.

Impact absorbing mechanism 80 includes an optional raised portion 86 on deck 40 that extends away from deck 40 toward frame 24. Raised portion 86 is configured to cooperate with arms 84 on cushioning members 82. Alternatively, raised portion 86 of deck 40 can be eliminated and arms 84 of cushioning members 82 extended to directly contact deck 40 as in the embodiment illustrated in FIG. 3.

Impact absorbing mechanism 80 with cushioning members 82, as depicted in FIG. 4, are somewhat similar to the embodiment of cushioning members 50 illustrated in FIG. 2. Like the embodiment depicted in FIG. 2, arms 84 or base 92 of cushioning members 82 have different sized openings 88 formed therein and form a plurality of portions in cushioning members 82 having differing cushioning properties. Openings 88 are differently sized and as a result arms 84 each have differing amounts of stiffness. As shown, one of arms 84 of cushioning members 82 does not have an opening 88 formed therein which further changes the stiffness of that arm 84. What is important is that each arm 84 have a discrete and differing amount of flexibility and deflection in response to a user exercising on belt 32 as a result of the differing stiffness. Cushioning members 82, consequently, will provide a differing amount of cushioning depending on which of arms 84 is in contact with deck 40.

Impact absorbing mechanism 80 also comprises an elongated lever 90, as shown in phantom in FIG. 4, configured to manually adjust cushion members 82. Lever 90 is one embodiment of structure capable of performing the function of manually adjusting cushioning members 82 so as to selectively select one of the plurality of portions of cushioning members 82 between frame 24 and deck 40.

Figure 5:
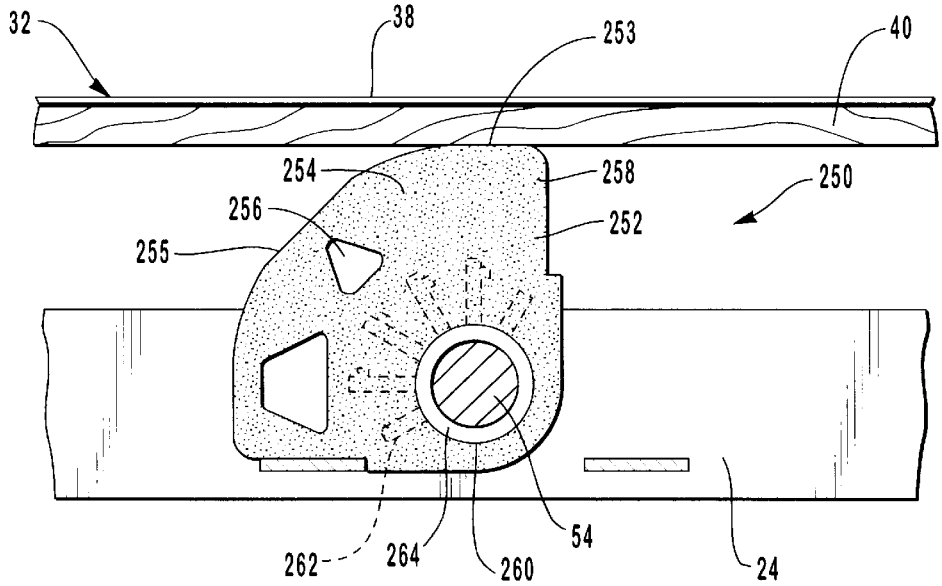
FIG. 5 is a partial cross-sectional elevation view of another embodiment of a cushioning mechanism.

FIG. 5 illustrates another embodiment of an impact absorbing mechanism 250 that comprises cushioning members 252. Like the cushioning members depicted in FIGS. 1–4, cushioning members 252 are movably attached to frame 24 and are disposed substantially perpendicular to deck 40. Cushioning members 252 comprise a plurality of portions having different cushioning properties. Cushioning members 252 comprise a substantially fan-shaped base 254 having different flattened surfaces 255 extending around the rim 253 of base 254.

Base 254 of cushioning members 252 has different sized openings 256 formed therein, forming a plurality of portions in cushioning members 252 having differing cushioning properties. Openings 256 are differently sized and as a result, different portions of base 254 have differing stiffness. As shown, one of the portions 258 of cushioning members 252 does not have an opening 256 formed therein. This further changes the stiffness of that portion 258. What is important is that each portion have a discrete and differing amount of flexibility and deflection in response to a user exercising on belt 32 as a result of the differing stiffness. Cushioning members 252, consequently, will provide a differing amount of cushioning depending on which portion contacts deck 40.

Impact absorbing mechanism 250 also comprises a hub 260 coupling base 254 to axle 54. Hub 260 includes fingers 262 (shown in phantom lines) extending radially from a hub sleeve 264 disposed about axle 54 and coupled to axle 54 through the use of a screw (not shown) disposed through sleeve 264 and axle 54. In one embodiment, base 254 comprises a flexible polyvinylchloride material which is molded onto a nylon or glass-filled nylon hub 260. By way of example, the polyvinylchloride material may have a durometer of about 65, shore A.

In one embodiment, impact absorbing mechanism 250 is positioned toward the front end 20 of base 12, e.g., within the front one-third of base 12. This positioning is particularly useful when the front end 20 of deck 40 is not secured to frame 24, e.g., when the back end 22 of deck is secured to frame 24 (through the use of screws, for example), while the front end 20 moves freely from frame 24. Allowing front end 20 to freely deflect from frame 24 enhances the ability to adjust the amount of cushioning applied to deck 40. In one such embodiment, front end 20 of deck 40 also rests on at least one additional cushioned member such as an isolator coupled to each side of frame 24, such as discussed below with reference to FIG. 11.

Figure 6A:
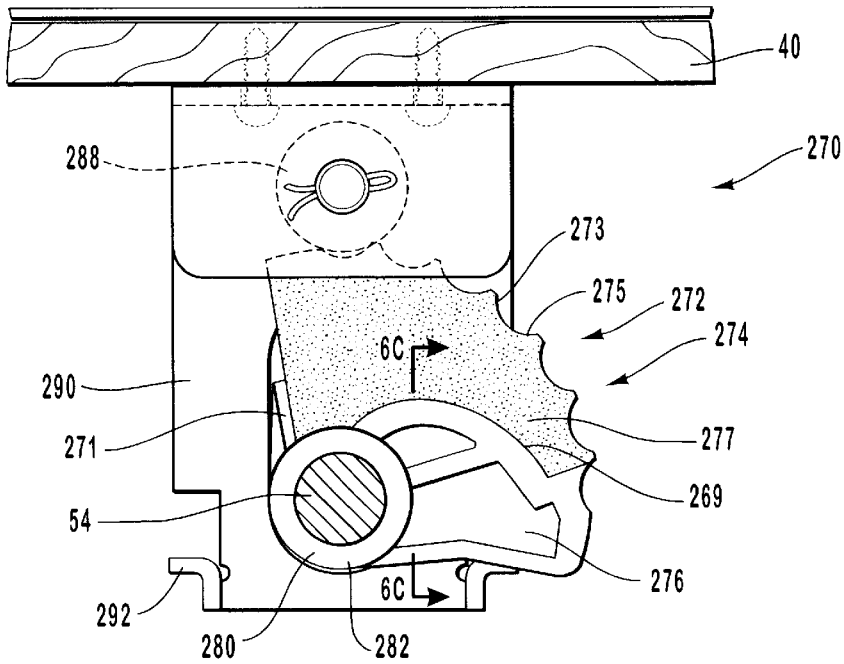
FIGS. 6*a*–6*c* feature a partial cross-sectional elevation views of another embodiment of a cushioning mechanism.
Figure 6B:
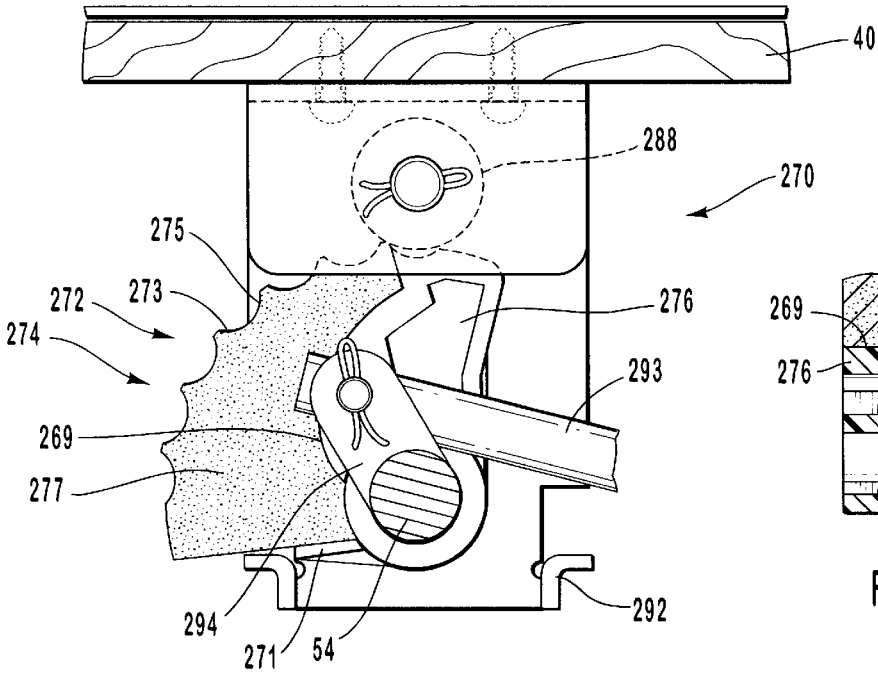
Figure 6C:
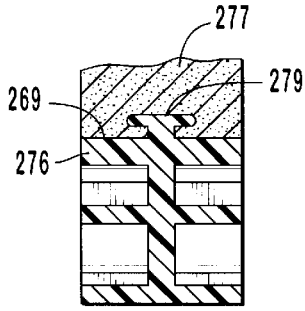

FIGS. 6*a*–6*c* illustrate another embodiment of an impact absorbing mechanism 270 that comprises cushioning members 272. Cushioning members 272 are movably attached to frame 24 and are disposed substantially perpendicular to deck 40. Cushioning members 272 comprise a plurality of portions having different cushioning properties. Each cushioning member 272 comprises a substantially fan-shaped base 274 having a plurality of recesses 275 extending around the rim 273 of base 274.

Base 274 of cushioning member 272 comprises a flexible portion 277 attached through adhesion or molding to a substantially more rigid portion 276, forming a plurality of portions in cushioning members 272 having differing cushioning properties. As a result, different portions of base 274 have differing stiffness. Cushioning members 272, consequently, will provide a differing amount of cushioning depending on which portion contacts a wheel pivotally coupled to deck 40, as discussed below.

Impact absorbing mechanism 270 also comprises a hub 280 coupling base 274 to axle 54. Hub 280 comprises a hub sleeve 282 coupled to base 274. In one embodiment, hub sleeve 282 is integrally coupled to member 276 and to a plate 271, such that flexible portion 277 is cradled within plate 271, hub 280 and member 276.

Hub sleeve 282 is disposed about axle 54 and coupled to axle 54 through the use of a screw (not shown) disposed through sleeve 282 and axle 54, for example. In one embodiment, flexible portion 277 comprises a flexible polyvinylchloride material which is molded onto a significantly more rigid nylon or glass-filled nylon member 276 and plate 271. Hub 280 may also comprise nylon or glass-filled nylon. By way of example, the polyvinylchloride material 277 may have a durometer of about 55, shore A.

Impact absorbing mechanism 270 further comprises a wheel 288 rotatably coupled to deck 40. In one embodiment, bracket 290 couples wheel 288 to deck 40. Wheel 288 is configured to mate with a selected recess 273 on cushioning member 272. Wheel 288 turns as cushioning member 272 turns. This assists in preserving the material of cushioning member 272 from damage as member 272 is turned. Stops 292 coupled to bracket 290 prevent the overrotation of cushioning member 272.

As yet another feature of impact absorbing mechanism 270, as shown in FIG. 6*b*, axle 54 includes a tab 294 coupled to axle 54. In a preferred embodiment, a motor, such as an extension motor, has an arm 293 thereof pivotally coupled to tab 294. Upon actuating the motor, such as by pressing a button coupled to the console of the treadmill, the motor rotates the axle 54. The button and motor pivotally coupled to axle 54 serve as another example of a structure capable of performing the function of manually adjusting cushioning members 272 so as to selectively select one of the plurality of portions of cushioning members 272 between frame 24 and deck 40.

In one embodiment, impact absorbing mechanism 250 is positioned toward the front end 20 of base 12, e.g., within the front one-third of base 12. One or both of front and back ends 20, 22 of deck 40 are secured to frame 24.

As shown in FIG. 6*c*, in one embodiment, member 276 comprises a rim 269 having a T-shaped member 279 extending therefrom. Member 279 is covered by flexible portion 277 and enhances the adhesion of flexible portion 277 to the more rigid member 276.

Figure 7:
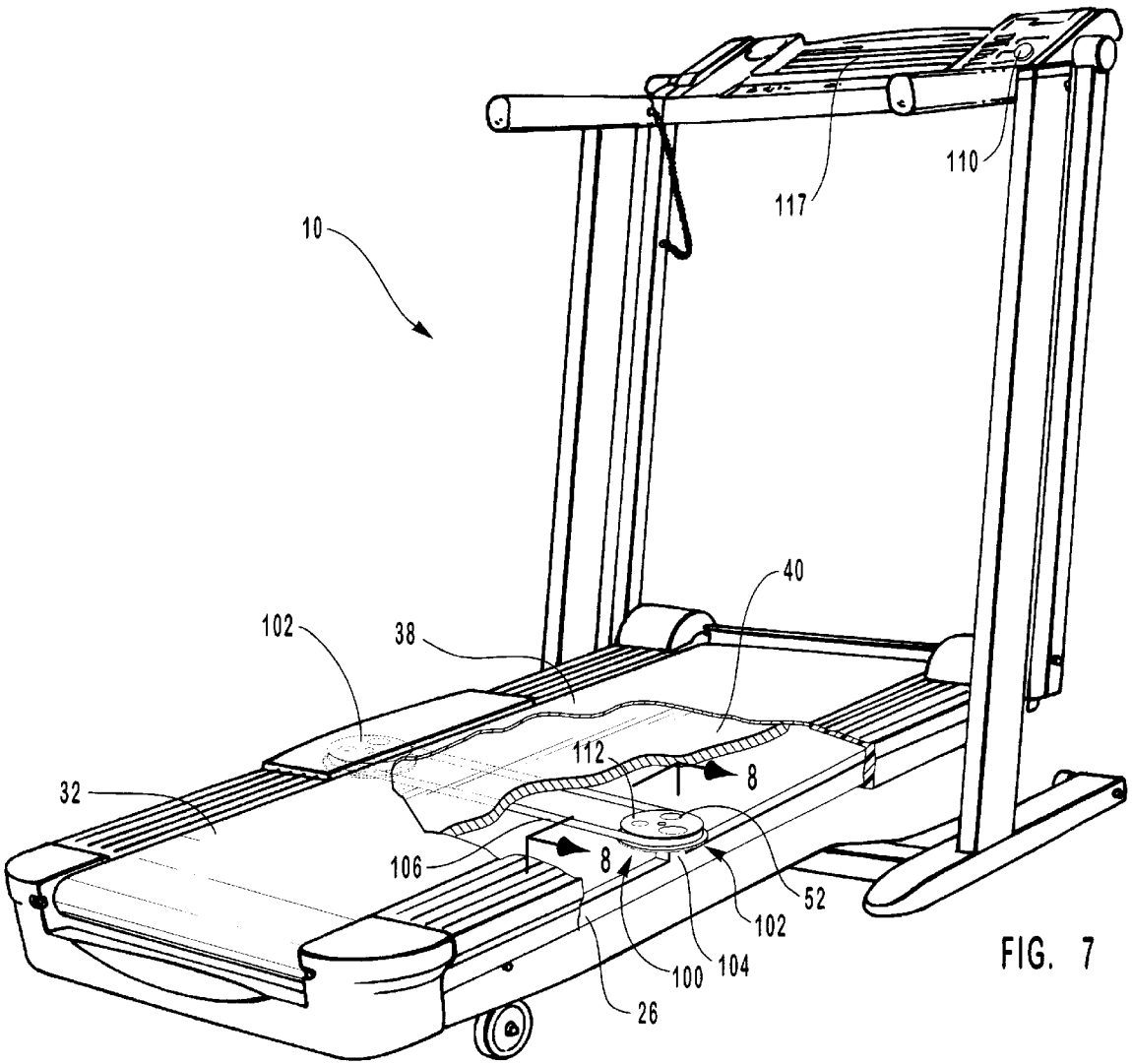
FIG. 7 is a partial cutaway perspective view of a treadmill with another embodiment of a cushioning mechanism.
Figure 8:
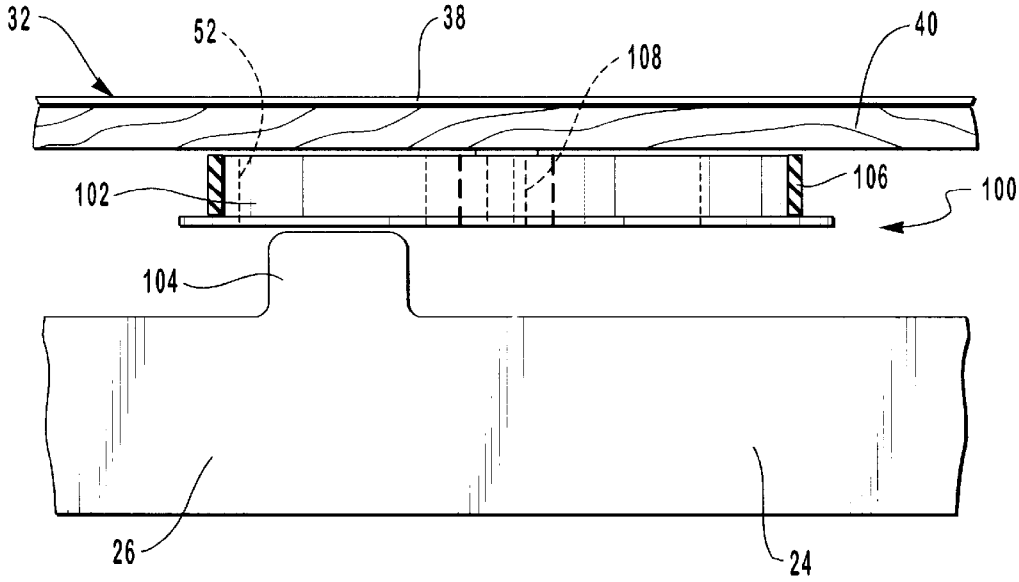
FIG. 8 is a partial cross-sectional elevation view of the cushioning mechanism of FIG. 7 taken along section line 8–8 therein.

FIGS. 7 and 8 depicts treadmill 10 with another embodiment of an impact absorbing mechanism 100 configured for manual adjustment to provide selectable amounts of impact cushioning when a user is operating on exercise section 38 of belt 32. Impact absorbing mechanism 100 comprises cushioning members 102. As shown in FIG. 8, cushioning members 102 are substantially parallel to deck 40 and are at least partially disposed between deck 40 and frame 24. Cushioning members 102 can be movably attached to either deck 40 or frame 24. As depicted in FIG. 8, cushioning members 102 are rotatably attached to deck 40 by a vertical axle 108.

Right frame member 26 and left frame member (not shown) of frame 24 have raised portion 104 formed thereon. Raised portions 104 extend upwardly towards deck 40 and contact cushioning members 102. Cushioning members 102 illustrated in FIGS. 7 and 8 have substantially the same configuration as cushioning members 50 depicted in FIGS. 1 and 2. Cushioning members 102 comprise a plurality of portions having different cushioning properties. Cushioning members 102 comprise a base 112 with a plurality of openings 52 formed therein. Bases 112 of cushioning members 102 are shown as round, but it is intended, particularly in this embodiment, that cushioning members 102 may have various other shapes without effecting the function thereof. Cushioning members 102 may be square, rectangular, oval, or various other configurations.

As depicted in FIG. 7, treadmill 10 has a knob 110 on console 17 that causes cushioning members 102 to be selectively adjusted according to the desired amount of cushioning. Knob 110 on console 17 is one embodiment of structure capable of performing the function of a means for manually adjusting cushioning members 102 to provide differing amount of impact cushioning. Various other embodiments of structure capable of performing the function of such a means for manually adjusting members 102 including those disclosed with other embodiments of cushioning members, are equally effective.

Impact absorbing mechanism 100 also comprises a linkage or a cable 106, shown in FIG. 7, configured to mechanically interconnect cushioning members 102 such that movement of one cushioning member 102 results in corresponding movement of other cushioning members 102. Various embodiments of structure capable of performing the function of such means for mechanically interconnecting cushioning members 102, including those disclosed with other embodiments of cushioning members, are equally effective. For example, horizontal axle 54 can be mechanically interconnected with vertical axles 108 of cushioning members 102 such that movement of one of cushioning members 102 results in corresponding movement of other cushioning members 102.

Although bases 112 of cushioning members 102 are depicted as having various sized openings 52 formed therein, other embodiments of cushioning members 102 perform the function thereof equally effectively. For example, instead of openings 52 formed in bases 112 of cushioning members 102, raised pads comprising materials with different cushioning properties can be mounted on cushioning members 102. Cushioning members 102 can be manually adjusted such that the raised pads mounted on cushioning members 102 are selectively positioned on raised portion 104. In addition, instead of cushioning members 102 being pivotally mounted below deck 40, cushioning members 102 can be movably attached to frame 24 by vertical axles.

Figure 9:
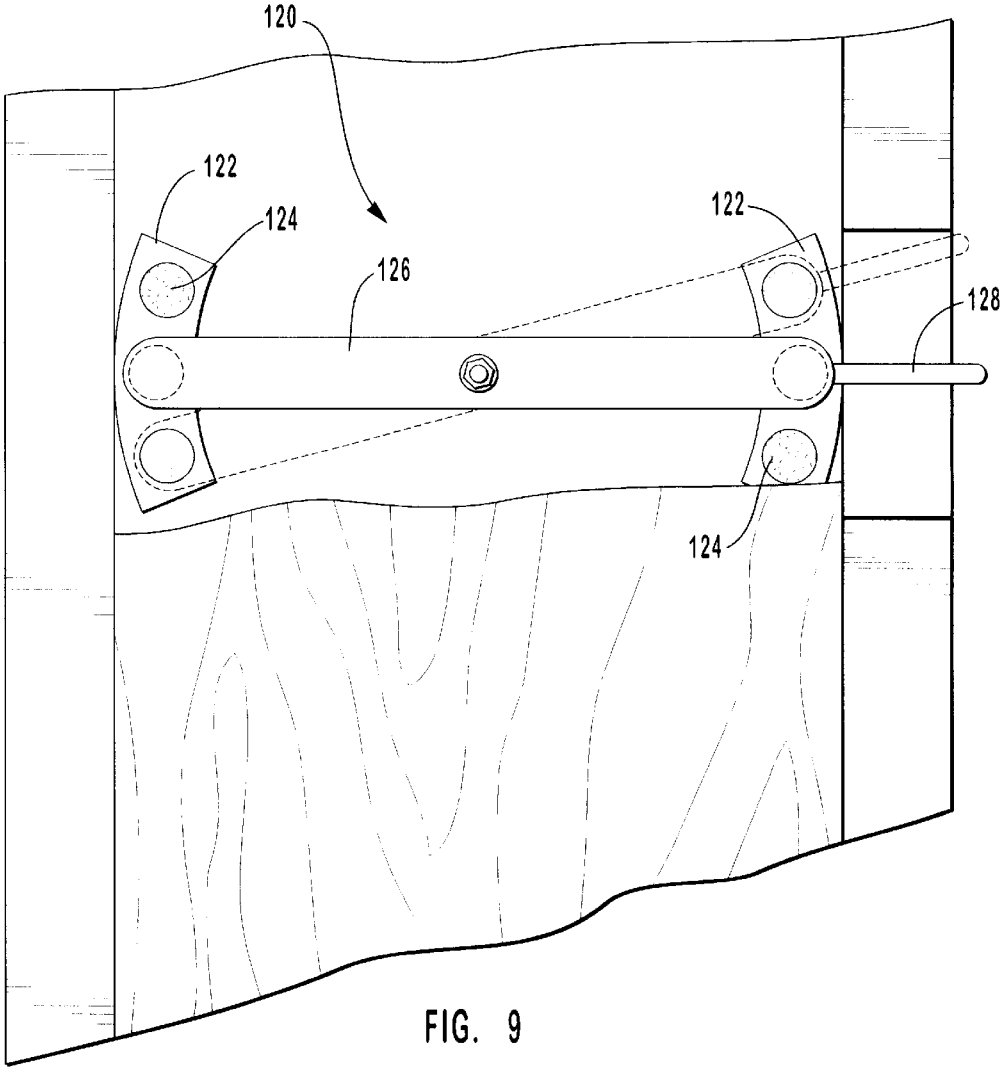
FIG. 9 is a partial cutaway top elevation view of another embodiment of a cushioning mechanism.

Another embodiment of an impact absorbing mechanism 120 is depicted in FIG. 9. Impact absorbing mechanism 120 comprises cushioning members 122 attached to opposite sides of frame 24. Cushioning members 122 are elongated and in the embodiment shown in FIG. 9 are substantially curved. Various other configurations, however, perform the function thereof equally effectively. For example, cushioning members 122 can be rectangular, square, semispherical, half an oval, half-an-ellipse, or semicircular. As illustrated, cushioning members 122 comprise bases 30 that have a plurality of raised pads 124 mounted thereon. Raised pads 130 each comprise a material with different cushioning properties. The arrangement of raised pads 124 on cushioning members 122 on side one is in an inverse mirror image cushioning members 122 on the opposite side of frame 24 as will be discussed in more detail below.

Impact absorbing mechanisms 120 also comprise an elongated beam 126 movably mounted below deck 40. Beam 126 extends across frame 24 and is substantially parallel to deck 40. A portion of beam 126 is disposed between deck 40 and cushioning members 122 to contact the various raised pads 124. Beam 126 is pivotally connected to deck 40. Raised pads 124 are arranged on cushioning members 122 so that beam 126 is pivoted to contact one type of raised pad 124 on cushioning members 122 and the opposite end of beam 126 contacts the same material on the opposite of cushioning members 122 as illustrated in FIG. 9.

Beam 126 is another embodiment of structure capable of performing the function of such means for mechanically interconnecting the plurality of cushioning members 122. Beam 126 has an elongated handle 128 attached to one end thereof for the user to grasp to selectively, manually adjust the amount of cushioning provided by cushioning members 122. A user of treadmill 10 can move beam 126 by moving handle 128 until beam 126 contacts the selected raised pads 124 to obtain differing amounts of cushioning of the impact. FIG. 9 illustrates in phantom an example of another position of beam 126 for a differing amount of cushioning. Handle 128 extends away from beam 126 above frame 24. Handle 128 is one example of structure capable of performing the function of means for selectively positioning one of the plurality of portions of cushioning members 122.

Cushioning members 50, 68, 82, 102 and 122 are one embodiment of structure capable of performing the function of impact absorbing means for manually adjustably cushioning impact between deck 40 and frame 24.

Figure 10:
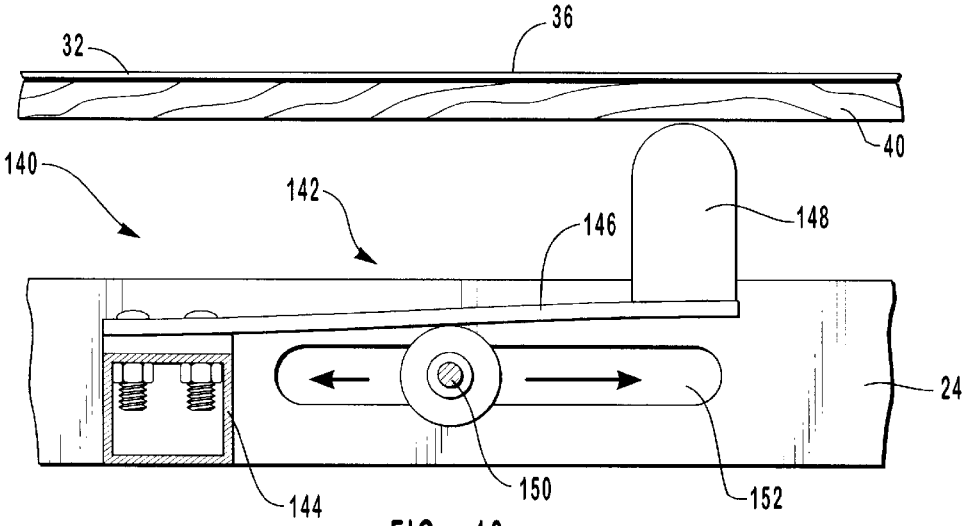
FIG. 10 is a partial cross-sectional elevation view of another embodiment of a cushioning mechanism.

FIG. 10 illustrates another embodiment of impact absorbing mechanism 140 that comprises a plurality of flexible cantilevers 142. Cantilevers 142 comprises a support 144 attached to the inside surface of frame 24 and extends in a direction away from frame 24. Cantilevers 142 comprise an elongated flexible arm 146 that is attached at one end to support 144. Arm 146 extends toward front end 20 of frame 24. Arm 146 has an opposite end that is freely disposed from support 144 and frame 24. Cantilevers 142 also comprises a bumper 148 mounted on the free end of arm 146. Bumper 148 extends away from free end of arm 146 toward deck 40 in a direction that is substantially perpendicular to deck 140.

Impact absorbing mechanism 140 includes an elongated brace 150 that is configured to manually adjust the flexibility of cantilevers 142. Brace 150 is mounted to frame 24 adjacent to cantilevers 142. Brace 150 extends substantially perpendicular to the longitudinal axis of frame 24 and is configured to cooperate with frame 24 and to move parallel to the longitudinal axis of frame 24. As depicted in FIG. 10, frame 24 has elongated slots 152 formed therein to accommodate movement of brace 150. Brace 150 is selectively movable along the longitudinal axis of frame 24 and the length of cantilever 142 to change in the amount of cushioning provided by cantilevers 142 by increasing or decreasing the amount of deflection of arm 146 in response to a user operating on the exercise section 38 of belt 32. For example, if brace 150 is moved along the length of cantilevers 142 towards bumper 148 on arm 146, the amount of deflection or amount of cushioning is decreased. In contrast, if brace 150 is moved towards support 144, the amount of deflection will increase which consequently results in the amount of cushioning provided to the user increasing.

Various other configurations of brace 150 and slots 152 perform the function thereof equally effectively as long as brace 150 and slots 152 are configured to cooperate together. Brace 150 and slots 152 in frame 24 are one example of structure capable of performing the function of an adjustment means for manually adjusting the flexibility of cantilever 142.

It can be appreciated that although the various embodiments illustrated in the figures usually have two (2) cushioning members or two (2) cantilevers, any other number of a plurality of cushioning members or cantilevers can be used in treadmill 10.

Although not shown in the figures, it is contemplated that treadmill 10 includes structure such as a drive means for supplying power to exercise base 12 to drive continuous belt 32. The drive means for supplying power to base frame 12 is disposed in front end 20 of exercise base 12. One embodiment of structure capable of performing the function of such a drive means comprises a motor that rotates a first pulley and drives a belt. The belt drives a second pulley which is connected to front roller 34 about which belt 32 is disposed. As previously stated, the rear portion of belt 32 is also disposed around rear roller 36. Other embodiments capable of performing the function of such a drive means may include a flywheel. The flywheel is connected to belt 32 and receives energy from the user operating on belt 32 of exercise base 12. The flywheel also delivers energy to belt 32 as the user performs walking, running or jogging exercises when a user is suspended and not in contact with belt 32.

Figure 11:
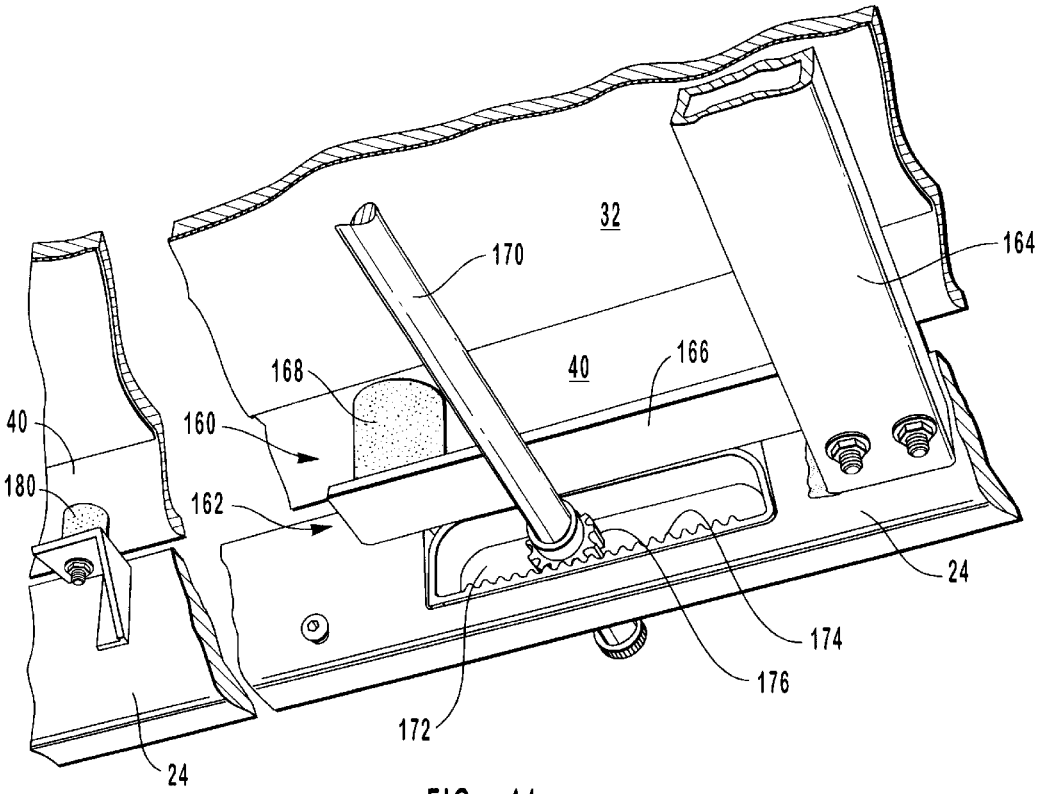
FIG. 11 is a partial cross-sectional perspective view of another embodiment of a cushioning mechanism.

FIG. 11 illustrates yet another embodiment of an impact absorbing mechanism 160 that comprises a plurality of flexible cantilevers 162, only one of which is shown in FIG. 11. Cantilever 162 comprises a support 164 attached to the inside surface of frame 24, such as a cross beam. Cantilever 162 further comprises an elongated arm 166, such as a steel or other metal arm that is attached at one end to support 164. Arm 166 extends toward front end 20 of frame 24. Arm 166 has an opposite end that is freely disposed from support 164 and frame 24.

Cantilever 162 also comprises a bumper 168 mounted on the free end of arm 166. Bumper 168 extends away from the free end of arm 166 toward deck 40 in a direction that is substantially perpendicular to deck 40. As another example of a cantilever, another elongated arm and a bumper attached thereto (not shown) extends from an opposing end of support 164 in parallel relationship to the cantilever 162 shown in FIG. 11. In one embodiment, bumper 168 is positioned toward the front end 20 of base 12, e.g., within the front one-third of base 12.

Impact absorbing mechanism 160 further includes an elongated brace 170 that is configured to manually adjust the flexibility of cantilevers 162. Brace 170 is mounted to frame 24 adjacent to cantilevers 162. Brace 170 extends substantially perpendicular to the longitudinal axis of frame 24 and is configured to cooperate with frame 24 and to move parallel to the longitudinal axis of frame 24.

As depicted in FIG. 11, frame 24 has elongated slots 172 formed therein to accommodate movement of brace 170. A second slot is not shown in FIG. 11, but is preferably on an opposing side of frame 24 from slot 172 for receiving an opposing end of brace 170 from that shown in FIG. 11. Brace 170 is selectively movable along the longitudinal axis of frame 24 within opposing slots 172 and along the length of opposing cantilevers 162 to change the amount of cushioning provided by cantilevers 162 by increasing or decreasing the amount of deflection of arms 166 in response to a user operating on the exercise section 38 of belt 32. For example, if brace 170 is moved along the length of cantilever 162 towards bumper 168 on arm 166, the amount of deflection or amount of cushioning is decreased. In contrast, if brace 170 is moved towards support 164, the amount of deflection will increase which consequently results in the amount of cushioning provided to the user increasing.

Also as shown in FIG. 11, in one embodiment, each of the opposing slots 172 have teeth 174 therein for selectively receiving gears 176 coupled to opposing ends of brace 170. Said teeth 174 and gears 176 allow convenient adjustment of brace 170 within slots 172 and assist in maintaining brace 170 in a desired orientation within slots 172 during an exercise routine. By moving brace 170 forward and backward within opposing slots 172, each of the opposing cantilevers 162 is adjusted, preferably achieving an equal degree of deflection.

Various other configurations of brace 170 and slots 172 perform the function thereof equally effectively as long as brace 170 and slots 172 are configured to cooperate together. Brace 170 and slots 172 in frame 24 are one example of structure capable of performing the function of an adjustment means for manually adjusting the flexibility of cantilever 162.

As mentioned above, in one embodiment, front end 20 of deck 40 is not secured to frame 24. Instead, back end 22 of deck 40 is secured to frame 24 (through the use of screws, for example), while front end 20 moves freely from frame 24, enhancing the ability to adjust the amount of cushioning applied to front end 20 of deck 40.

In one such embodiment, at least one and preferably both sides of front end 20 of deck 40 also rest on a cushioned isolator 180, shown in FIG. 11, without being coupled to the isolator 180. However, in another embodiment, front end 20 and back end 22 of deck 40 are both coupled to frame 24 through the use of screws, for example. The screws may be disposed through the deck, the frame, and an isolator, such as isolator 180 disposed between the frame and the deck, for example.

Figure 12:
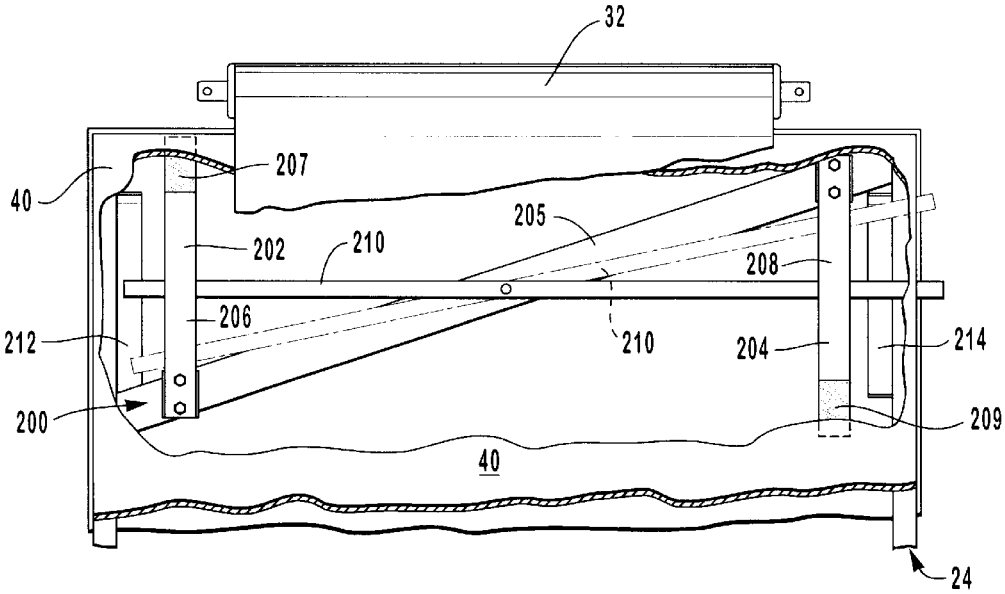
FIG. 12 is a partial cut-away top elevation view of another embodiment of a cushioning mechanism.

Another example of an impact absorbing mechanism 200 that comprises a plurality of flexible cantilevers 202, 204 is shown in FIG. 12. Cantilevers 202, 204 comprise a support 205 attached to frame 24 diagonally with respect to the longitudinal axis of frame 24. Cantilevers 202, 204 further comprise respective elongated arms 206, 208 attached to opposing ends of diagonal support 205. Bumpers 207, 209 are coupled to free ends of respective arms 206, 208 below deck 40. Bumpers 207, 209 extend upwardly with respect to respective arms 206, 208 and intersect deck 40. As shown, bumpers 207, 209 and arms 206, 208 of respective cantilevers 202, 204 are oriented in opposing directions.

Impact absorbing mechanism 200 further includes an elongated brace 210 that is configured to manually adjust the flexibility of cantilevers 202, 204. Brace 210 is mounted to frame 24 by being pivotally coupled to support 205. Brace 210 has opposing ends which are disposed beneath respective arms 206, 208. Frame 24 has elongated slots 212, 214 formed therein on opposing sides to accommodate pivotal movement of the ends of brace 210. Brace 210 moves along the length of opposing cantilevers 202, 204 to change in the amount of cushioning provided by cantilevers 202, 204 by increasing or decreasing the amount of deflection of arms 202, 204. One advantage of mechanism 200 is that the amount of cushioning provided is adjustable by pivoting brace 210 in a desired direction.

Brace 210 and slots 212, 214 in frame 24 are one example of structure capable of performing the function of an adjustment means for manually adjusting the flexibility of cantilevers 202, 204.

The present invention may be embodied in other specific forms without departing from its spirit or essential characteristics. The described embodiments are to be considered in all respects only as illustrated and not restrictive The scope of the invention is, therefore, indicated by the appended claims rather than by the foregoing description. All changes which come within the meaning and range of equivalency of the claims are to be embraced within their scope.

What is claimed and desired to be secured by United States Letters Patent is:

1. A treadmill comprising:

(a) a frame;

(b) an endless belt trained on said frame, said belt having an upwardly exposed exercise section;

(c) a deck disposed between said exercise section of said belt and said frame; and (d) impact absorbing means for adjustably cushioning impact between said deck and said frame, said impact absorbing means comprising a member having a cantilevered configuration.

2. A treadmill as recited in claim 1, wherein said impact absorbing means comprises:

(a) a flexible cantilever having a first end mounted to said frame and an opposing second end biased against said deck; and (b) means for manually adjusting the flexibility of said cantilever.

3. A treadmill as recited in claim 2, wherein the impact absorbing means for adjustably cushioning comprises impact absorbing means for manually, adjustably cushioning.

4. A treadmill as recited in claim 2, wherein said cantilever comprises:

(a) a flexible arm having a first end mounted to said frame and an opposing second end freely disposed from said frame; and (b) a bumper extending between said second end of said flexible arm and said frame.

5. A treadmill as recited in claim 1, wherein said impact absorbing means comprises a first cushioning member and further comprising a second cushioning member, said first and second cushioning members being disposed on opposing sides of said frame between said frame and said deck.

6. A treadmill as recited in claim 5, further comprising means for mechanically interconnecting said first and second cushioning members such that movement of said first cushioning member results in corresponding movement of said second cushioning member.

7. A treadmill comprising:

(a) a frame;

(b) an endless belt trained on said frame, said belt having an upwardly exposed exercise section;

(c) a deck disposed between said exercise section of said belt and said frame; and (d) a flexible cantilever having a first end fixedly mounted to said frame and an opposing second end contacting said deck so as to thereby cushion said deck when a user ambulates on the endless belt.

8. A treadmill as recited in claim 7, wherein said cantilever comprises:

(a) a flexible arm having a first end fixedly mounted to said frame and opposing second end freely disposed from said frame; and (b) a bumper extending between said second end of said flexible arm and said deck.

9. A treadmill as recited in claim 8, wherein said bumper is mounted to said flexible arm.

10. A treadmill as recited in claim 7, further comprising means for manually adjusting the flexibility of said cantilever.

11. A treadmill as recited in claim 10, wherein the means for manually adjusting the flexibility of said cantilever comprises a brace mounted to said frame adjacent to said cantilever, said brace being selectively moveable along the length of said cantilever.

12. A treadmill comprising:

(a) a frame;

(b) an endless belt trained on said frame, said belt having an upwardly exposed exercise section;

(c) a deck disposed between said exercise section of said belt and said frame;

(d) a plurality of cantilevers, wherein each of said cantilevers comprises:

(i) a flexible arm having a first end fixedly mounted to said frame and an opposing second end freely disposed from said frame; and (ii) a bumper mounted to said flexible arm extending between said second end of said flexible arm and said deck; and (e) a mechanism configured to manually adjust the flexibility of each of said cantilevers.

13. A treadmill as recited in claim 12, wherein the means for mechanism configured to manually adjust the flexibility of each of said cantilevers comprises a brace mounted to said frame adjacent to each of said cantilevers, said brace being selectively moveable along the length of each of said cantilevers.

14. A treadmill as recited in claim 12, wherein said bumper on each of said plurality of cantilevers are oriented in opposing directions from one another.

15. A treadmill as recited in claim 14, wherein mechanism configured to adjust the flexibility of each of said cantilevers comprises a brace pivotally mounted to said frame.

16. A treadmill comprising:

(a) a frame;

(b) an endless belt trained on said frame, said belt having an upwardly exposed exercise section;

(c) a deck disposed between said exercise section of said belt and said frame; and (d) an impact absorbing mechanism configured to adjustably cushion the impact between said deck and said frame, said impact absorbing mechanism comprising a member having a cantilevered configuration.

17. A treadmill as recited in claim 16, wherein said impact absorbing mechanism comprises at least one flexible cantilever having a first end fixedly mounted to said frame and an opposing free end.

18. A treadmill as recited in claim 16, wherein the impact absorbing mechanism is configured to manually, adjustably cushion the impact between said deck and said frame.

19. A treadmill comprising:

(a) a frame;

(b) an endless belt trained on said frame, said belt having an upwardly exposed exercise section;

(c) a deck disposed between said exercise section of said belt and said frame; and (d) impact absorbing means for adjustably cushioning impact between said deck and said frame, said impact absorbing means comprising:

(i) a flexible cantilever having a first end fixedly mounted to said frame; and (ii) a brace mounted to said frame adjacent to said cantilever, said brace being selectively moveable along the length of said cantilever.

20. A treadmill as recited in claim 19, wherein the cantilever comprises a bumper on one end thereof, the bumper of a first cantilever being oriented in an opposing position from a bumper of a second cantilever.

21. A treadmill as recited in claim 19, further comprising a second cantilever coupled to said frame, said second cantilever being oriented in an opposing direction from the first cantilever.

22. A treadmill as recited in claim 21, further comprising a brace configured to selectively adjust the flexibility of both the first and second cantilevers by selectively pivoting the brace.

* * * * *

UNITED STATES PATENT AND TRADEMARK OFFICE

CERTIFICATE OF CORRECTION

PATENT NO. : 6,652,424 B2
DATED : November 25, 2003
INVENTOR(S) : William T. Dalebout It is certified that error appears in the above-identified patent and that said Letters Patent is hereby corrected as shown below:

Title page,
Item [56], References Cited, OTHER PUBLICATIONS, "Macmillan" reference, change "Publishin" to -- Publishing --
After "*Primary Examiner* -Glen E." change "Richmon" to -- Richman --
Item [57], ABSTRACT,
Line 8, after "type of" change "exercises." to -- exercise. --.

Column 2,
Line 44, before "learned" change "maybe" to -- may be --
Line 46, after "invention" change "maybe" to -- may be --
Line 50, change "herein" to -- herein, --
Line 56, after "type of" change "exercises." to -- exercise. --

Column 3,
Line 33, change "is partial" to -- is a partial --
Line 45, before "partial" remove "a"

Column 4,
Line 16, before "structure" insert -- a --
Line 54, after "mentioned" insert -- , --

Column 5,
Line 9, before "related" change "similar" to -- similarly --
Line 12, after "front" insert -- end --
Line 21, change "front end 22" to -- front end 20 --
Line 50, after "mechanism" insert -- 48 --

Column 6,
Line 9, after "portion of" insert -- base 58 of --
Line 11, before "cushioning" insert -- base 58 of --
Line 12, change "flexibility that" to -- flexibility of that --
Line 14, after "size of" change "openings allows" to -- openings. This allows --
Line 27, after "bases" change "48" to -- 58 --
Line 48, after "deck" change "38" to -- 40 --
Line 51, after "mechanism" insert -- 48 --
Line 60, before "structure" insert -- a --

UNITED STATES PATENT AND TRADEMARK OFFICE

CERTIFICATE OF CORRECTION

PATENT NO. : 6,652,424 B2
DATED : November 25, 2003
INVENTOR(S) : William T. Dalebout It is certified that error appears in the above-identified patent and that said Letters Patent is hereby corrected as shown below:

Column 7,
Line 5, before “be something” remove “just”
Line 13, before “knob” insert -- a --
Line 23, before “structure” insert -- a --
Line 49, before “of cushioning” delete “58”

Column 8,
Line 29, after “stiffness” change “characteristic” to -- characteristics --
Line 48, after “Cushioning” change “member” to -- members --
Line 58, before “illustrated” change “92” to -- 82 --

Column 9,
Line 6, change “82 extended” to -- 82 can be extended --
Line 19, after “arm 84” change “have” to -- has --
Line 27, after “adjust” change “cushion” to -- cushioning --
Line 28, before “structure” insert -- a --
Line 51, after “portion” change “have” to -- has --

Column 11,
Line 8, change “depicts” to -- depict --
Line 32, change “effecting” to -- affecting --
Line 39, 42 and 51, before “structure” insert -- a --
Line 41, after “differing” change “amount” to -- amounts --

Column 12,
Line 21, after “image” insert -- of --
Lines 35, 47 and 51, before “structure” insert -- a --
Lines 56 and 62, after “Cantilevers 142” change “comprises” to -- comprise --
Line 65, after “perpendicular to” change “deck 140.” to -- deck 40. --

Column 14,
Line 25, after “increase” insert -- , --

Column 15,
Line 13, after “change” remove “in”
Line 20, before “structure” insert -- a --

UNITED STATES PATENT AND TRADEMARK OFFICE

CERTIFICATE OF CORRECTION

PATENT NO. : 6,652,424 B2
DATED : November 25, 2003
INVENTOR(S) : William T. Dalebout It is certified that error appears in the above-identified patent and that said Letters Patent is hereby corrected as shown below:

Column 16,
Line 19, after "and" insert -- in --
Line 50, remove "means"
Line 51, remove "for"
Line 59, after "wherein" insert -- the --

Signed and Sealed this

Twelfth Day of October, 2004

JON W. DUDAS
*Director of the United States Patent and Trademark Office*

UNITED STATES PATENT AND TRADEMARK OFFICE

CERTIFICATE OF CORRECTION

PATENT NO. : 6,652,424 B2 
APPLICATION NO. : 09/777141
DATED : November 25, 2003
INVENTOR(S) : Dalebout et al.

It is certified that error appears in the above-identified patent and that said Letters Patent is hereby corrected as shown below:

Column 2
Line 59, after "type of", change "exercises" to --exercise--

Column 4
Line 7, after "type of", change "exercises" to --exercise--

Column 5
Line 39, change "platform 44" to --platforms 44--

Column 6
Line 16, change "adjustably" to --adjust--

Column 10
Line 3, after "deck" insert --40--

Signed and Sealed this

Twenty-fourth Day of October, 2006

JON W. DUDAS
*Director of the United States Patent and Trademark Office*